United States Patent [19]

Russell

[11] 4,341,344

[45] Jul. 27, 1982

[54] AUTOMATIC DRAFT CONTROLLER

[76] Inventor: Robert J. Russell, 1332 Lymric Way, Bakersfield, Calif. 93309

[21] Appl. No.: 124,089

[22] Filed: Feb. 25, 1980

[51] Int. Cl.[3] ..... F23N 3/02

[52] U.S. Cl. ..... 236/45; 110/163; 49/387; 403/104; 403/362

[58] Field of Search ..... 236/45; 126/292; 110/163; 137/527.8; 403/104, 362; 49/387

[56] References Cited

U.S. PATENT DOCUMENTS

| | | | |
|---|---|---|---|
| 1,320,298 | 10/1919 | Waldorn . | |
| 1,775,065 | 9/1930 | Brown | 126/292 |
| 1,848,850 | 3/1932 | Sturgis | 236/45 |
| 1,973,997 | 9/1934 | Roberts | 236/45 |
| 2,126,994 | 8/1938 | Irsch et al. | 236/45 |
| 2,179,940 | 11/1939 | Lawson | 236/45 |
| 2,186,354 | 1/1940 | Whetstine | 126/293 |
| 2,268,348 | 12/1941 | Stephenson | 236/45 |
| 2,291,018 | 7/1942 | Bachmann | 236/45 |
| 2,297,757 | 10/1942 | Field, Jr. | 236/45 |
| 2,335,740 | 11/1943 | Cole | 236/45 |
| 2,340,283 | 1/1944 | Vladu | 110/163 X |
| 2,388,253 | 11/1945 | Dady | 236/45 |
| 2,433,749 | 12/1947 | Field, Jr. | 236/45 |
| 2,435,166 | 1/1948 | Stephenson | 236/45 |
| 2,441,398 | 5/1948 | D'elia | 126/293 |
| 2,509,284 | 5/1950 | Allen | 403/104 X |
| 2,539,815 | 1/1951 | Dady | 236/45 |
| 2,555,687 | 6/1951 | Field, Jr. | 236/45 |
| 2,687,256 | 8/1954 | Puffer | 236/45 |
| 2,743,056 | 4/1956 | Hubbard | 236/45 |
| 2,783,756 | 4/1957 | Crizier | 126/292 |
| 3,070,313 | 12/1962 | Steinen | 236/45 |
| 3,206,670 | 9/1965 | Pfister | 236/45 |
| 3,236,228 | 2/1966 | Hodgins | 236/45 X |
| 3,297,251 | 1/1967 | Pfister | 236/45 |
| 3,362,634 | 1/1968 | Steinen | 236/45 |

*Primary Examiner*—William E. Tapolcai, Jr.
*Attorney, Agent, or Firm*—Knobbe, Martens

[57] ABSTRACT

A draft control plate, which automatically opens or closes to provide efficient draft conditions in a furnace, is provided with both horizontal and vertical counterbalance devices which respectively permit adjustment of the initial position of the plate and the sensitivity of its movements. Initially, the plate is partially open where it remains while the furnace is operating under normal conditions. It is then capable of opening or closing in response to changes in the pressure differential across it. Preferably, the plate is horizontally mounted in an auxiliary flue channel which is adjacent to and in connection with the main flue of the furnace.

20 Claims, 6 Drawing Figures

Fig. 3
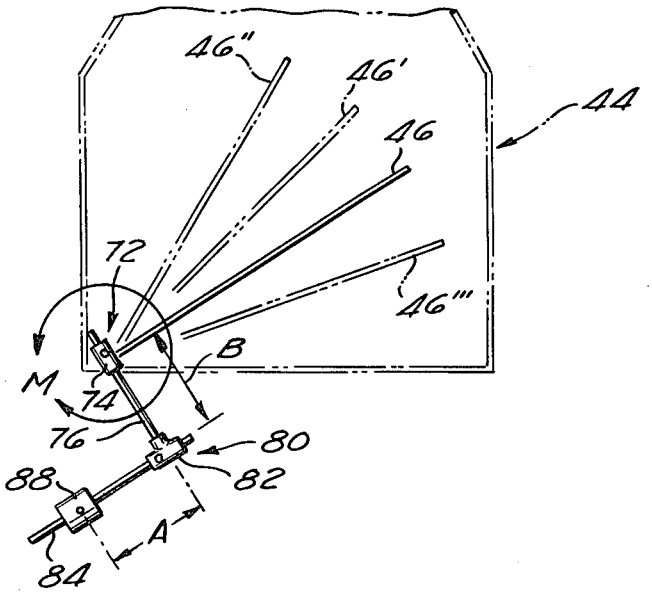
Fig. 4
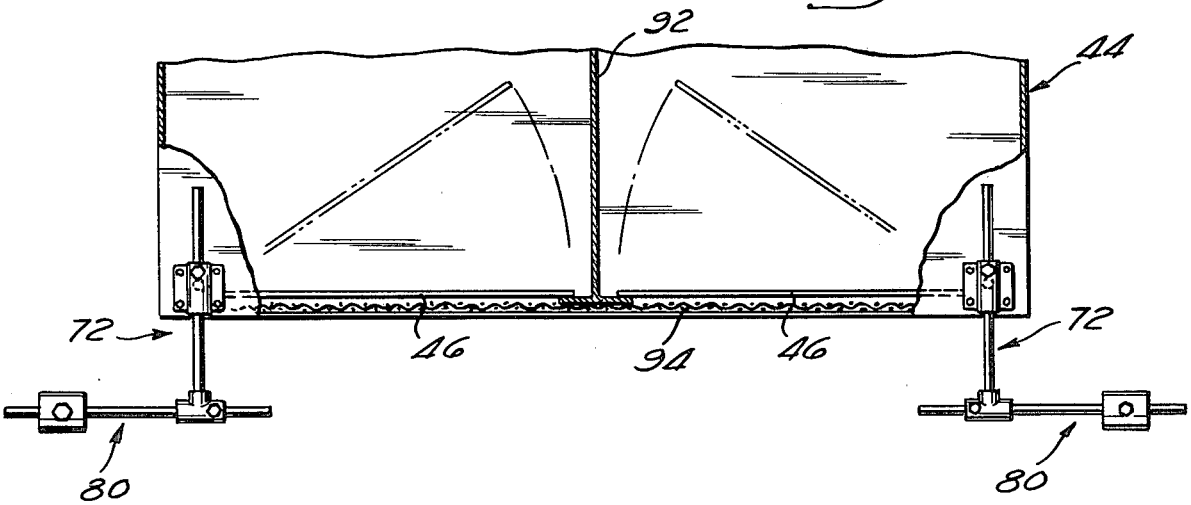
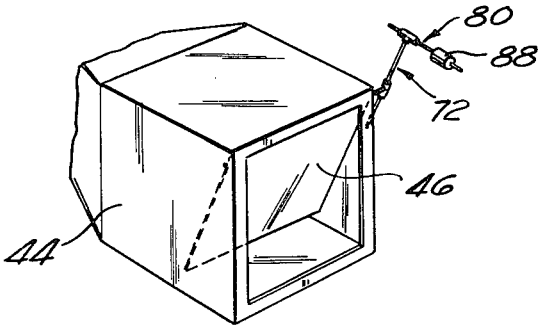
Fig. 5
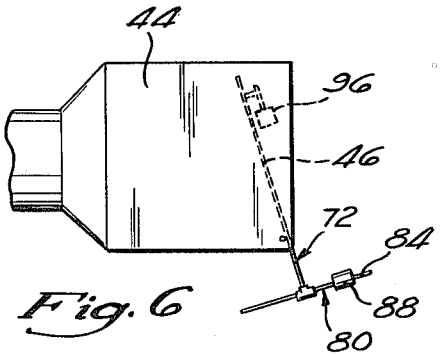
Fig. 6

AUTOMATIC DRAFT CONTROLLER

BACKGROUND OF THE INVENTION

The present invention relates to an automatic draft control plate which is capable of maintaining efficient draft conditions in the operation of a furnace. The plate is provided with a horizontal counterbalance, which is used to initially set the plate in a partially open position, and a vertical adjustment to vary the sensitivity of its movements in accordance with changes in ambient conditions.

Gas, coal and oil burning furnaces are very prevalent in our society and have many industrial, commercial, and residential applications. For example, it is common in industrial plants for large furnaces to be utilized in conjunction with a heat exchanging device to heat a particular material as an essential step in the processing of that material. Thus, in the refining of oil to produce gasoline and other petroleum products, crude oil must be heated in large outdoor furnaces as a part of the refining or "cracking" process. Thereafter, hydrogen or other byproducts of the cracking process must be again heated in similarly large furnaces. Thus, it is common in oil refineries for as many as 25 to 50 oil or gas-fired furnaces to be in constant 24-hour operation.

As in a typical furnace, an oil refinery furnace consists of a firebox, a heat exchange section, and a tall stack or flue to permit the escape of the gaseous byproducts of the furnace's operation. Combustion occurs in the firebox where fuel, fed into the burners at a predetermined rate, is mixed with air drawn in at the base of the furnace. The burners typically have draft regulators which, to a certain extent, can be used to control the amount of air or "draft" being mixed with the fuel. Furthermore, these large refinery furnaces sometimes have a firebox and heat exchange section which is as large as 10 to 20 feet in diameter and a stack of up to 200 feet in height. The temperature in the heat exchange section often reaches 1500 degrees Fahrenheit. These furnaces consume massive amounts of oil and natural gas, fuels which have become extremely expensive in the past few years. In fact, with around-the-clock operation of these furnaces, the annual fuel costs incurred in operating each one of these furnaces can exceed $200,000. Therefore, small improvements in the efficiency of the operation of a furnace can yield large savings in fuel costs.

The efficiency of a refinery furnace is determined by the ability of the furnace to heat the crude oil flowing through it to the desired temperature while using a minimum amount of fuel. As is well known in the art, the maximum amount of heat which can be derived from the consumption of a specific amount of fuel occurs when there has been "perfect combustion". Perfect combustion occurs when the ingredients of that combustion, fuel and air, are completely consumed and only the gaseous byproducts of combustion, such as carbon dioxide and water vapor, remain. Non-perfect combustion is inefficient because the existence of excess combustion ingredients deprives the flame of heat and requires the consumption of additional fuel in order to heat the crude oil to the desired temperature.

Thus, the efficiency of the furnace's operation can be determined by measuring the amount of fuel or air which is not consumed in the combustion process.

In order to avoid inefficient excess oxygen conditions in the byproducts of the furnace's combustion, it is essential that the amount of air entering the burners of the furnace not be excessive. The entrance of this air, commonly termed the "draft" of the furnace, is caused by the rapid ascent of the hot gaseous byproducts of combustion. These gaseous byproducts are much less dense and have a much higher temperature than the ambient air surrounding the furnace. They therefore rise rapidly through the flue of the furnace where they are mixed with the cooler outside air. The rising flue gases create a partial vacuum or a low pressure area in the firebox of the furnace, causing convection currents of outside air, which is at ambient atmospheric pressure, to be drawn into the furnace. These convection currents constitute the "draft" of the furnace, and if they exceed the amount needed for perfect combustion, the furnace will be operating inefficiently.

As is well known in the art, the amount of draft, i.e., the volume of air entering the burners, depends upon pressure differential between ambient pressure and the low pressure in the firebox caused by the rising flue gases. The higher the velocity of these gases, which is a function of their temperature, the lower the pressure in the firebox and in turn the greater pressure differential. Thus, the velocity of the draft, and in turn the volume of draft air entering the furnace, increases or decreases, respectively, with an increase or decrease in the velocity of the flue gases.

In contrast to the problem of excess oxygen caused by high draft velocity, perfect combustion can also be prevented by the presence of excess fuel, or in other words insufficient draft velocity. When this condition occurs, the fuel fed into the burners is not completely consumed in the combustion, as evidenced by the presence of dark or black smoke coming from the stack. The smoke is darkened because it consists not only of the gaseous byproducts of the combustion but also of minute carbon particles and other particulates. The presence of this heavier particulate matter slows the velocity of the byproducts of the combustion as they travel up the stack. Furthermore, as with excess combustion oxygen, these particulates deprive the combustion process of heat, cooling the surrounding combustion gases, and further decreasing their velocity. Therefore, an insufficient amount of draft air enters the furnace and the problem of fuel-rich combustion is compounded. As a result, the furnace produces less than the maximum amount of heat and fuel consumption must be increased.

Thus, draft conditions in a furnace are critical for maintaining its efficient operation and the conservation of fuel.

Although perfect combustion, or zero percent excess or deficient oxygen, is an ideal goal for furnace combustion, this condition is not practical to attain in practice. Air leaks through holes and other openings in the furnace, faulty burner and air regulator operation, and other contributory problems have made 3–5 percent excess oxygen a practical goal for efficient furnace operation. Therefore, the efficiency of the furnace can be conveniently monitored by measuring the oxygen content in the gaseious byproducts of combustion and maintaining it in this range.

Heretofore, improper draft control has been the major contributing factor to inefficient furnace operation, making even this goal of 3–5 percent of excess oxygen difficult to achieve. As discussed above, changes in the draft velocity may be caused by controllable factors, such as the amount of fuel fed into the burners. For example, an increase in the furnace's fuel consumption produces oxygen deficient combustion, resulting in dark smoke, less heat generation and lower flue gas velocity. Consequently, draft velocity also decreases and the oxygen deficiency is compounded.

Inefficient draft conditions can also be caused by several uncontrollable factors, consisting primarily of changes in ambient conditions. For example, a wind blowing across the top of the stack will create a low-pressure area at that point, increasing the velocity of flue gases and that of the draft as well. It should also be pointed out that winds at the top of tall refinery furnace stacks are usually much stronger than at the base of the furnace. Thus, it is common for such winds to create excess oxygen conditions in the furnace which reach 10 to 12 percent.

Also, a decrease in temperature of the surrounding air will increase its density. Therefore, if the velocity of the draft remains unchanged, a condition of excess oxygen will result since the volume of air entering the furnace contains more oxygen molecules. Furthermore, if atmospheric pressure increases, the pressure differential between ambient and the firebox is greater, increasing the velocity of the draft. Again, the amount of oxygen being drawn into the furnace becomes excessive.

Each of these changes in fuel supply or ambient conditions affect the velocity and/or amount of draft, thereby changing the combustion characteristics of the furnace and decreasing the efficiency of its operation. That is, each change results in either excessive or insufficient oxygen conditions in the furnace. However, as explained above, these changes also affect the velocity of the flue gases. For example, a large increase in the fuel supply to the furnace, as discussed above, can result in smoke, cooler combustion, and a lower flue gas velocity. As just mentioned, a wind blowing over the stack of the furnace also increases the velocity of the gases rising in the flue.

Therefore, it is common to compensate for these changes in draft intensity by providing the furnace with a damper plate in the flue to control the velocity of the flue gases. That is, if the draft velocity should become excessively high, increasing the desirable amount of excess oxygen, the damper can be adjusted to partially obstruct the flue. This obstruction decreases the flue gas velocity and, in turn, decreases the velocity and amount of draft air drawn into the furnace. Thus, the amount of excess oxygen is reduced to a permissible range. On the other hand, if an increase in draft conditions is desirable, the damper can be adjusted to permit the unobstructed passage of flue gases, increasing the draft velocity.

Typically, these flue dampers are manually operated and therefore must be adjusted with each change in operating conditions. Thus, this method of draft control is very disadvantageous since it increases the labor costs associated with operating the furnace or if sufficient manpower is unavailable, the furnace is permitted to operate inefficiently. Furthermore, a very common problem associated with these flue dampers is that, with time, they become inoperative because their bearings deteriorate and stick as a result of their exposure to the extremely hot gases flowing in the flue. Thus, even if manpower is available to properly adjust these dampers, they cannot be used for efficient draft control.

It is also well known to provide the furnace with a channel, in communication with the main flue, in which an auxiliary damper is mounted. This type of auxiliary damper installation has the advantage of removing the damper from the direct path of the hot gases in the flue. Although these auxiliary dampers are also used to regulate the velocity of the flue gases, their operation is different from that of dampers mounted in the main flue of the furnace. That is, if the draft velocity increases undesirably, rather than obstructing the flow of gases in the main flue in order to inhibit the entrance of air into the burners of the furnace, outside air is drawn into the flue through the auxiliary damper and channel. This cooler outside air mixes with the hot flue gases, reduces their temperature and velocity, and, in turn, reduces the velocity of the draft.

Outside air is drawn in through these auxiliary dampers much like draft air is drawn into the burners. The velocity of flue gases creates a low static pressure inside the stack which is less than ambient atmospheric pressure. Thus, outside air is drawn into the flue in response to this pressure differential. An auxiliary "draft" is established into the flue which can be used, by adjusting the position of the auxiliary damper plate in the channel, to control the main draft through the furnace burners. If, for efficiency reasons, this main draft should be decreased, the damper plate is open to permit the flow of outside air; if the main draft should be increased, the plate is closed so that the flue gas velocity as well as the draft velocity will be increased.

It has also been found that these auxiliary dampers, to a limited extent, can be mounted to provide automatic draft control under certain conditions. For example, an undesirable increase in the draft velocity will result from an increase in the velocity of the flue gases, thereby lowering the static pressure in the stack. Prior art dampers are constructed and mounted so that they will automatically open, permitting outside air to flow into the flue, in response to the increased pressure differential between ambient air and the flue gases. This cooler outside air reduces the temperature and velocity of the flue gases and, in turn, the velocity of the draft air, restoring efficient operating conditions.

However, auxiliary damper plates of the prior art, although somewhat automatic in controlling draft intensity, are not sufficiently sensitive to changes in draft conditions. For example, prior art plates will not open to permit the flow of outside air until the pressure differential across the plate is sufficient to overcome its own weight. Therefore, until the velocity of the flue gases is sufficient to establish such a pressure differential, inefficient draft conditions are permitted to persist. On the other hand, a plate whose weight is only barely sufficient to maintain it in a closed position flaps wildly in response to large changes in pressure differential. As a result, draft conditions may be lower or higher than desirable for efficient operating conditions. Therefore, auxiliary dampers of the prior art are not sensitive to the changes in draft conditions which often occur.

A further substantial disadvantage associated with auxiliary dampers of the prior art is that they normally operate in a closed position, totally preventing outside air from entering the flue. Under these conditions, if the velocity of the draft should be increased, such as for example when more fuel is burned, the auxiliary damper is unable to permit more air to be drawn in at the base of the furnace. Thus, insufficient oxygen conditions persist, resulting in inefficient furnace operation.

Thus, the prior art has not met the need for an automatic draft controller which is capable of increasing as well as decreasing the velocity and amount of the draft according to changes in operating conditions of the furnace. Furthermore, there is a need for an automatic draft controller which can be adjusted to provide appropriately sensitive movements in response to changes in the draft of the furnace.

SUMMARY OF THE PRESENT INVENTION

The automatic draft controller of the present invention fills the void created by the prior art damper plates, providing for the constant efficient operation of a furnace. The damper plate of the present invention is provided with both horizontal and vertical counterbalance devices which are used to position the plate in an initially open position, permitting it to sensitively respond to changes in operating conditions by opening to decrease the draft intensity or closing to increase it. Following the plate's response to such changes, it will return to its original position automatically, in order to continue the maximum efficient operation of the furnace.

The draft control plate of the present invention is mounted in a draft box which is in communication with an auxiliary flue channel mounted adjacent the main flue of the furnace. Thus, the present damper plate is protected from the heat of the gases flowing in the main flue. In one embodiment, a single square or rectangular plate is mounted in the auxiliary flue channel so as to be horizontally disposed when in a closed position. The plate is attached along one of its edges to a rotating shaft whose ends are mounted in permanently sealed, precision bearings which provide sensitive plate rotation in response to minute changes in ambient conditions. In other embodiments, the plate can be vertically mounted in the flue and can be utilized with other similar plates in a single auxiliary flue. The damper plate/draft box assembly can be easily installed on existing furnace stack with only minimal interruption of the around-the-clock operation of the furnace.

The vertical adjustment device of the present invention is disposed at right angles to the preferred horizontal arrangement of the plate. It is comprised of a rod which is slidably adjustable in a bracket mounted on one end of the axis of the plate. The horizontal adjustment device is comprised of a horizontal rod slidably adjustable in a bracket which is attached to the lower end of the rod of the vertical adjustment device. This horizontal adjustment device is also provided with a weight which is slidable along the length of the rod.

Essentially, the purpose of the rod and weight of the horizontal adjustment device is to counterbalance the weight of the plate itself and to set the plate initially in a partially open position in order to achieve the desired draft conditions. The purpose of the vertical adjustment device, on the other hand, is to vary the sensitivity of the plate's rotational movements. That is, as the plate rotates upward to a wider opened position, a corrective torque or moment, acting in the opposite direction, is exerted on it through the rod of the vertical adjustment device. This moment is caused by the weight of the horizontal adjustment device acting through the rod of the vertical adjustment device and the weight of the plate itself. It resists the opening movement of the plate, tending to return the plate to its original, partially opened position. The magnitude of the movement changes as the plate moves away from its equilibrium position, and the rate of this magnitude change can be varied by changing the length of the rod of the vertical adjustment device. Thus, the sensitivity of the plate's movements can be regulated.

The plate of the present invention provides for constantly efficient draft control by automatically compensating for changes in operating conditions. As mentioned, the plate is initially counterbalanced by the horizontal adjustment device so that it is in a partially open position. Thus, under normal operation some air will be drawn in from outside of the stack, through the damper plate and the auxiliary flue, and into main flue of the furnace. The air regulators on the burners of the furnace can then be adjusted so as to provide for maximum efficient operation of the furnace, i.e., an excess oxygen content of from 3–5 percent.

If the draft and flue gas velocities in the furnace should increase, the pressure differential across the plate will also increase, causing it to open and permitting the entrance into the flue of more outside air. Thus, for example, if changes in wind, temperature, or atmospheric pressure conditions cause these velocities to increase, the present plate will quickly and automatically return them to efficient levels. Similarly, if draft and flue gas velocities decrease due to an increase in fuel consumption, the pressure differential across the plate will also decrease, resulting in the entrance of less outside air and a higher, more efficient main draft velocity.

Therefore, the present invention offers significant advantages over damper plates of the prior art in that the weight of the present plate is counterbalanced, permitting sensitive plate responses to changes in pressure differential across it. Furthermore, since the plate is initially open, it can close in response to insufficient draft conditions.

Moreover, unlike plates of the prior art, the sensitivity of the plate's movements can be adjusted by using the vertical adjustment device, thereby increasing the efficiency of the furnace. For example, if a strong gusty wind is blowing across the top of the furnace stack, the intermittent gusts tend to sporadically increase the velocity of the flue gases. Under these conditions, it is desirable to adjust the rod of the vertical adjustment device downward to increase its length. Therefore, as the plate opens in response to the increased pressure differential created by the wind, the magnitude of the corrective moment will increase very rapidly. Thus, the plate will be less sensitive to such changes in conditions and its movements will dampen out quickly. This downward adjustment counteracts the affect of the frequent gusts and prevents the plate from flapping wildly.

On the other hand, where it is anticipated that a decrease in temperature will be the primary ambient condition change, it is desirable to shorten the vertical rod and therefore decrease the rate at which the corrective moment increases. Thus, the plate is more sensitive to gradual, minute changes in the pressure differential acting on it.

In all cases, after the affects of the change in ambient conditions have passed, the draft control plate of the present invention will automatically return to its original, partially opened position, so as to maintain the efficient operation of the furnace.

In addition to the above-described structural advantages, the present plate can also be utilized in a method for initially setting up the draft control system in order to provide virtually fully-automatic draft control and constant efficient operation. In the first step of this method, the vertical adjustment device is positioned so as to make the plate more or less sensitive to changes in pressure differential across it. The air regulators on the burners of the furnace are then adjusted to be approximately 50 percent open, providing for the widest range of adjustment in either direction. Using the horizontal adjustment device, the damper plate of the present invention is initially balanced to be in a partially opened position. The furnace is then fired up and the oxygen content in the flue gases is checked. If inefficient conditions of excess oxygen exists, the air regulators on the burners can be closed in order to reduce the volume of draft air flowing into the burners.

However, if by closing this draft regulator, the excess oxygen cannot be sufficiently reduced to the desirable 3–5 percent level, the damper plate can be opened further, decreasing the draft to the appropriate level. At the same time, the air regulators of the burners are returned to the 50 percent open position. The draft conditions of the furnace will now be regulated virtually automatically; however, if fine tuning of the oxygen level is desired, the draft regulators can be conveniently used for this purpose.

Thus, a very significant advantage of the draft control plate of the present invention is that it is capable of automatically maintaining maximum efficiency in the operation of the furnace through all types of changes in operating conditions. Therefore, the present invention provides for the economical use of furnace fuel which, in the case of large refinery, can be translated into significant savings in fuel costs. It has been estimated that the utilization of the present damper plate can reduce fuel consumption in a typical refinery furnace by 10 to 20 percent annually. Where, as mentioned above, the cost of the fuel consumed by a typical refinery furnace is in excess of $200,000, this 10 to 20 percent reduction in fuel consumption results in a savings of $20,000–$40,000 annually for each furnace equipped with the draft controller of the present invention.

Furthermore, in addition to fuel savings, the automatic features of the present invention can also reduce labor costs associated with the operation of these large furnaces. This is because the constant monitorization necessary with furnaces and damper plates of the prior art is greatly reduced. As just described, once the horizontal and vertical adjustment devices of the present plate are initially set and coordinated with the air regulators of the burners to provide efficient draft conditions, only infrequent and minimal adjustments are necessary to maintain those conditions. Moreover, these adjustments can be conveniently made using the air regulators on the burners. Furthermore, the use of the draft control plate of the present invention can actually extend the life of the furnace since it eliminates the problem of excess oxygen combustion. Therefore, the oxidation and resulting deterioration of the internal components of the furnace are greatly retarded and the life of the furnace is substantially extended. The reduced fuel consumption and more perfect combustion achieved by a furnace equipped with the present invention also results in the production of less air pollutants. For example, it is believed that the introduction of outside air into the flue will reduce the amount of nitric oxides emitted by the furnace.

Finally, it should be pointed out that the principles of the present invention can be embodied in damper plates and other draft control devices which are used in all types of furnaces and fireplaces. Furthermore, these principles are applicable wherever any type of control plate must be sensitive to minute pressure differentials across it. The principles of the present invention have been described in relation to their application in a refinery furnace because of the dramatic fuel savings and efficiency of operation achieved by utilizing such a damper plate.

BRIEF DESCRIPTION OF THE DRAWINGS

FIG. 3 is a schematic side view of the draft box and plate of the present invention illustrating the manner in which the plate functions to regulate the draft in the furnace;

FIG. 4 is another embodiment of the present invention comprising multiple draft control plates mounted in a single draft box; and FIGS. 5 and 6 are perspective and side views, respectively, of another embodiment of the present invention wherein the present draft control plate is vertically mounted in the draft box.

DETAILED DESCRIPTION OF THE PREFERRED EMBODIMENT

Figure 1:
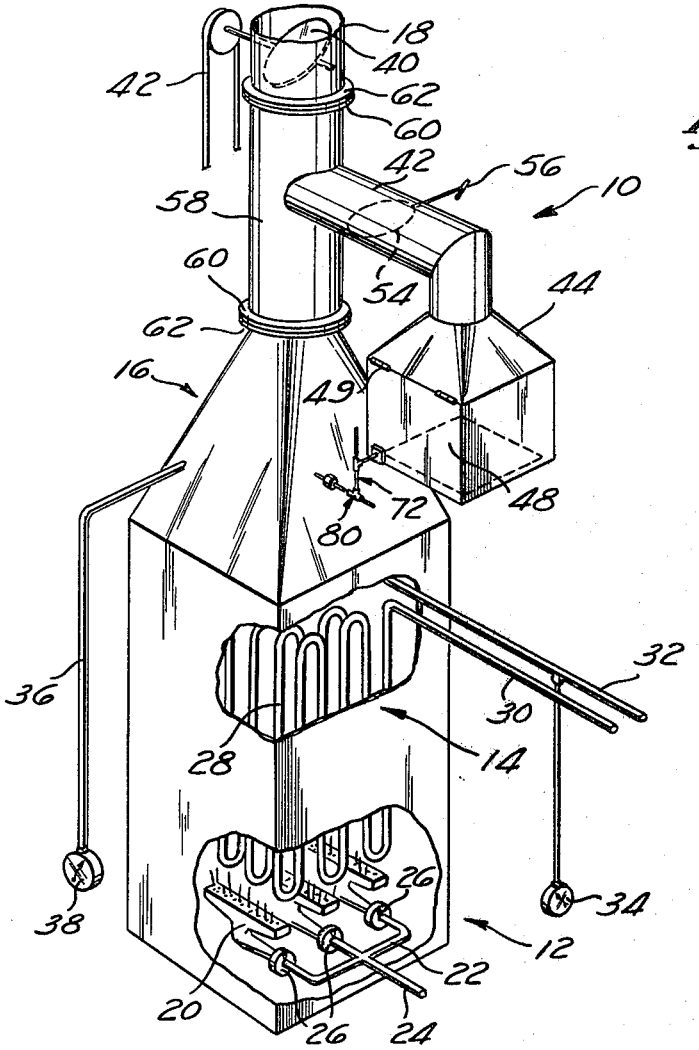
FIG. 1 is a perspective view of the draft control plate and assembly of the present invention as it is installed on a typical oil refinery furnace.

Referring to FIG. 1, there is shown a typical oil refinery furnace 10, including the firebox 12 at the base of the furnace, the heat exchange section 14 immediately above the firebox, and a stack or flue 18 which extends vertically upward from a transitional section 16 mounted above the heat exchange section 14. A portion of the firebox 12 is cut away to reveal the burners 20 of the furnace. Fuel is supplied to the burners through a manifold 22 and a fuel supply line 24. Typically, refinery furnaces have a main air regulator (not shown) in which the fuel and draft air are mixed prior to combustion in the burners. However, each burner is also supplied with a secondary air regulator 26 at each outlet of the manifold 22 which is capable of regulating to a limited extent the amount of air entering the burners.

A portion of the heat exchange section 14 is also cut away to reveal the heat exchanger 28 which consists of a long coiled tube disposed directly above the burners. Crude oil enters the heat exchanger 20 through an inlet 30 and is heated to the desired temperature as it flows through the numerous coils of the heat exchanger 28. The heated crude then exits the heat exchanger through an outlet 32 where a thermometer 34 regulates its temperature.

One end of an oxygen samples line 36 is inserted through the wall of the transitional section 16 of the furnace and the other end is attached to an oxygen analyzer 38. As described above, this oxygen analyzer 38 samples the gaseous byproducts of the combustion of the furnace 10 before they rise into the stack 18 and determines the amount of excess oxygen contained in them. Located in the stack 18 is a main flue damper 40 which is manually operated by a pulley arrangement 42, a portion of which is shown in FIG. 1. However, with the draft control system of the present invention in operation, this main flue damper 40 is not needed for draft control purposes and therefore is left in a fully-opened position.

Extending horizontally from the stack 18 from a point just above the transitional section 16 is an auxiliary flue channel 42 which angles downward and communicates with a draft box 44. Mounted horizontally in an opening at the bottom of the draft box is a rectangular draft control plate 46 of the present invention. Extending from one side 48 of the draft box 44 are the horizontal and vertical adjustment devices 80 and 72, respectively, of the draft control plate 46, which will be described in more detail below. The side 48 of the draft box 44 is hinged, as shown at 49 in FIG. 1, so that it can be lifted to permit access to and maintenance of the draft control plate. Such maintenance is further facilitated by an auxiliary damper 54 located in the auxiliary channel 42. This plate can be manually closed by the use of a handle 56 while the control plate is being repaired, or can remain partially closed in extremely windy areas to provide more control to the plate 46. Moreover, the damper 54 can be used to promote the sensitivity of the draft control plate 46 by being positioned partially closed when the furnace is operating at less than full capacity, thereby reducing the air slipstream in the channel 42. Thus, this auxiliary damper 54 can be used in conjunction with the draft plate 46 to efficiently control the draft in the furnace.

Advantageously, the auxiliary channel 42 is in communication with the stack 18 at a point just above the transitional section 16 and before the flue gases flowing therein achieve a laminar flow. Thus, the turbulence of the flue gases at this point facilitates the mixing of the cold ambient air entering the stack 18 through the control plate 46 and auxiliary channel 42. If this cold air were to enter the stack 18 at a point of laminar flue gas flow, it would expand and cause turbulence in the stack, thereby disrupting the draft control in the furnace. Preferably, the auxiliary channel 42 and draft box 44 are mounted on the lee side of the stack 18 so as to be sheltered from the effects of wind. Finally, as pointed out above, the draft control plate 46 is removed from direct exposure to the hot flue gases to preserve its bearings and insure its efficient operation over a long period of time.

The present draft control plate can be installed with very little loss in operational time. Preferably, the auxiliary channel 42, draft box 44, and control plate 46 are pre-assembled together and attached to a short vertical stack section 58 having flanges 60 at its opposite ends. The main stack 18 on the furnace 10 is then raised and the complete draft control assembly is mounted on the furnace 10 by attaching the flanges 60 of the short stack section 58 to corresponding flanges 62 on the stack 18, as shown in FIG. 1. Alternatively, the auxiliary channel 42 can be attached directly to an opening cut in the side of the stack 18, without the need for the vertical stack section 58 shown in FIG. 1.

Figure 2:
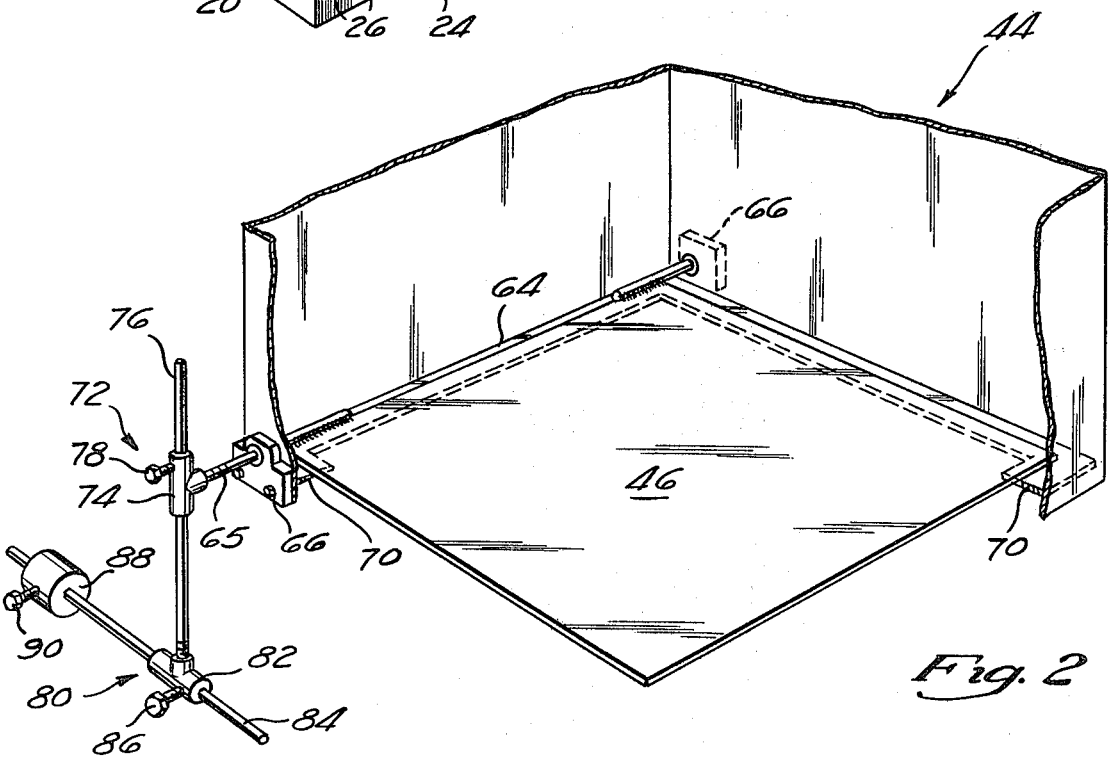
FIG. 2 is a perspective view of the draft box of the present invention partially cut away to illustrate the detail construction of the draft plate of the present invention.

FIG. 2 illustrates the detail construction of the draft control plate 46 and its mounting in the draft box 44. The draft control plate 46 is securely attached along one of its sides to a cylindrical shaft 64 which is mounted at opposite ends in two precision bearings 66. Thus, the plate 46 rotates with the shaft 64 as it turns at the bearings 66. To insure the sensitivity of the rotation of the present plate, these bearings 66 are sealed, permanently lubricated, and as troublefree and frictionless as possible.

The bearings 66 are mounted on the exterior of the draft box 44, as shown in FIG. 2, for easy access. Lining the interior of the draft box is a horizontal draft plate seat flange 70 which extends completely about the periphery of the opening in the floor of the draft box, as partially shown in FIG. 2. The flange is located about the height of the shaft 64 so that when the control plate 46 is completely closed, as shown in FIG. 2, it rests on the seat flange 70. This construction insures that when the draft plate 46 rotates to an open position, air will not enter the draft box 44 from behind the shaft 64, thus maintaining the plate's balance against the pressure differential across it.

One end 65 of the shaft 64 extends beyond the side of the draft box 44 and is attached to a vertical adjustment device 72. This vertical adjustment device is comprised of a T-shaped union member 74 which is bolted to the end 65 of the shaft 64 and slidably receives a vertical rod 76, which is adjustable in the T-shaped union 74. The vertical position of the rod 76 relative to the shaft 64 can be fixed by means of a set screw 78.

A horizontal adjustment device 80 is attached to the lower end of the rod 76 of the vertical adjustment device 72. It is comprised of a T-shaped union 82 welded to the end of the vertical rod 76 and has a horizontal rod 84 slidably adjustable in the union 82 and fixable with a set screw 86. A counterbalance weight 88 is also slidable on the horizontal rod 84 and its position is fixed by a set screw 90.

The method of operating the draft control plate of the present invention can be explained with reference to FIGS. 1 and 3.

Typically, the first step in this method is to purge the furnace 10 of air or other gases in order to prevent dangerous explosions when the furnace is first ignited. Normally, steam is used as a purging agent. For efficient purging, the counterbalance weight 88 and rod 84 of the horizontal adjustment device 80 are moved to the right (with reference to FIG. 3) to close the draft control plate 46 and prevent the entrance of outside air into the furnace.

As will be described in more detail below, the length B of the rod 76 of the vertical adjustment device 72 is then adjusted to provide appropriately sensitive rotation of the plate 46 in response to anticipated ambient conditions. Each air regulator 26 on the burners 20, shown in FIG. 1, is then adjusted so that it is approximately half open. By adjusting the rod 84 of the horizontal adjustment device 80 to the left so as to increase the distance A, the draft control plate 46 is brought to a partially open position, indicated at 46 in full lines in FIG. 3. That is, the horizontal adjustment device 80 is used to counterbalance the weight of the plate itself and set it in an initially open position.

The furnace is then started and permitted to operate until its normal operating temperature is reached. The oxygen content in the flue gases is then checked using the oxygen analyzer 38 shown in FIG. 1. The velocity of flue gases rising past the auxiliary channel creates a pressure differential across the draft control plate 46, causing it to open further, e.g., to the position 46' shown in FIG. 3. This pressure differential also causes outside air to flow past the control plate 46 through the draft box 44 and auxiliary channel 42 and into the flue 18. As explained above, this cold ambient air mixes with hot flue gases, cooling them slightly and decreasing their velocity. Concommitantly, the velocity of the draft air is decreased. As a result, the draft velocity is at a level below that which it would be if the plate were completely closed. The pressure differential in the furnace is registered on a manometer (not shown) which can be used in setting the draft control plate to achieve the desired draft conditions.

If, under these operating conditions, the amount of excess oxygen in the flue gases is only slightly outside of the ideal 3–5 percent range, the air regulators 26 on the burners 20 can be used to bring it within these acceptable limits. That is, from their initial 50 percent open position, the air regulators 26 can be slightly closed to decrease the draft flowing into the burners 20 and, in turn, to decrease the amount of excess oxygen to a desirable level; or the regulators 26 can be opened slightly more in order to increase the oxygen content in the flue gases, as needed. Thereafter, no significant draft adjustments are necessary.

However, if the adjustment range of the air regulators 26 on the burners is too small to properly adjust the oxygen level, the initial position of the draft control plate is modified in order to achieve efficient operating conditions. That is, if the air regulators must be substantially opened or closed before an efficient oxygen level is reached, or if that level cannot be reached, the regulators are returned to a half open position and the draft control plate 46 is further opened or closed as is appropriate to achieve an excess oxygen reading of 3–5 percent. The weight 88 attached to the rod 84 of the horizontal adjustment device 80 can be conveniently used for making these modifications in the initial position of the plate 46. Thus, it is preferable that the plate be initially opened to a point which permits the air regulators to have a maximum range of adjustment in either direction.

For example, if the draft velocity should be decreased, the distance A between the weight 88 and the rod 76 of the vertical adjustment device 72 is increased, causing the plate to open further and decreasing the amount of draft entering the base of the furnace. If the draft should be increased, the weight is shifted to the right, decreasing the distance A and causing the plate to close. Therefore, using the horizontal adjustment device 80, efficient oxygen conditions can be established. Periodically, the oxygen content of the flue gases is checked and if minor adjustments are necessary, the air regulators 26 on the burners 20 can be quickly and easily utilized for this purpose.

The draft control plate of the present invention will now automatically provide efficient draft conditions in the furnace, regardless of changes in ambient conditions or other operating perameters. Thus, if the velocity of the flue gases should increase, due for example, to a wind blowing across the top of the stack, the resultant increase in pressure differential across the plate will cause it to automatically open to position 46″ shown in FIG. 3. The entrance of the additional outside air will slow the velocity of the flue gases which in turn decreases the velocity of the draft of the base of the furnace and re-establishes efficient operating conditions. On the other hand, if the flue gas velocity should decrease due to a large increase in the fuel rate to the furnace, the decreased pressure differential will automatically cause the plate to close to the position 46‴ shown in FIG. 3, thereby increasing the draft to the furnace and restoring efficient draft conditions. After the wind has died down or the fuel rate has returned to its original level, the plate will automatically turn to its initial position 46′, again providing proper draft conditions for the maximum efficient operation of the furnace.

As mentioned above, the efficiency achieved by the present draft control plate is further enhanced by the use of the vertical adjustment device 72 to regulate the sensitivity and speed of the plate's movements. As will be seen below, this vertical adjustment alters the equilibrium position of the plate 46 established by the horizontal adjustment device 80; therefore, it is generally the first step in the above-described method. The combined gravitational forces of the horizontal adjustment device 80 and the plate 46 establish a corrective moment M which acts upon the plate. The magnitude of this moment M changes as the plate moves in either direction away from its initial equilibrium position. This is because the horizontal distance between the center of gravity of the horizontal adjustment device 80 and the shaft 64, i.e., the moment arm of moment M, is changing with the rotation of the plate.

This moment M will always resist the rotation of the plate tending to return it to its equilibrium position 46′ shown in FIG. 3. For example, if the plate opens to the wider position 46″, the moment M acts in a clockwise direction, which is the opposite direction of the plate's rotation, as shown. Or, if the plate rotates downward toward position 46″, a counterclockwise moment M is applied to it through the vertical adjustment device 80, tending to resist such downward rotation and return the plate to its original position 46′.

The rate at which the magnitude of this moment corrective M changes can be varied by adjusting the length of the rod 76 of the vertical adjustment device 72. As shown in FIG. 3, the length B, which is that portion of the vertical rod 76 between the shaft 64 and the rod 84 of the horizontal adjustment device 80, can be easily adjusted by sliding the rod 76 up or down in the T-shaped union 74. Thus, increasing the length B of the vertical rod 76 increases the rate at which the moment M increases since the horizontal distance between the center of gravity of the horizontal adjustment device 80 and the shaft 64 increases rapidly with changes in the plate's rotation. In other words, with a long length B, a small angular rotation of the plate 46 yields a significantly large corrective moment M. Under these conditions, the plate 46 will be relatively insensitive to changes in pressure differential across it, slow to respond to such changes, and quick to dampen out.

On the other hand, shortening the length B decreases the rate at which the moment M increases with changes in the plate's position. In this situation, small changes in the angular position of the plate produce only small changes in the distance between the center of gravity of the horizontal adjustment device 80 and the shaft 64, yielding only slow increases in the corrective moment M. Thus, the plate 46 will be sensitive to change in conditions and will rotate quickly and easily in response to such changes.

Thus, the sensitivity of the draft control plate in responding to changes in the pressure differential across it can be varied, according to the nature of the conditions which prompted the change, by increasing or decreasing the length B. This capability advantageously increases the draft control efficiency of the present invention. For example, if a gusty wind is blowing and the length B is short, the plate will open easily and widely because the resistive moment M is changing slowly. Furthermore, the plate's rotation will be slow to dampen out and the plate will not quickly return to its equilibrium position. Often times, as described above, it will flap wildly in response to periodic gusts of wind blowing across the top of the stack. Thus, the draft conditions of the furnace will vary widely and the furnace will not be operating with maximum efficiency.

Accordingly, it is advantageous to lengthen the distance B in order to increase the rate at which the moment M increases. The plate will then not flap wildly and will dampen out quickly, maintaining substantially constant, efficient draft conditions in the furnace.

On the other hand, a short length B may be desirable if a change in ambient temperature is the only anticipated change in operating conditions. This is because changes in pressure differential across the plate due to temperature will be minute and it will be advantageous for the plate to be as sensitive as possible to such small changes.

Thus, the draft control plate of the present invention can be quickly and easily adjusted to provide constantly efficient draft conditions in the furnace.

FIG. 4 illustrates another embodiment of the present invention in which more than one draft control plate 46 can be mounted in a single draft box 44. As shown, each draft plate has its own vertical and horizontal adjustments 72 and 80, respectively, to permit their independent or uniform regulation. In this multiple plate configuration, the plates 46 must be oriented so that their shafts 64 (not shown on FIG. 4) are at 90° to the position shown in FIG. 1. Such multiple draft plate arrangements are advantageous since the individual plates may be made smaller and therefore lighter and more sensitive to changes in pressure differential. Furthermore, more flexibility in draft control can be achieved with such an arrangement since one plate can be adjusted to be very sensitive while the other is more resistive to pressure changes. The draft box may be provided with a vertical wall 92 which separates the two draft control plates and serves as a baffle, guiding the flow of incoming air and reducing its turbulence. The draft box 44 can also be provided with a bird screen 94 to prevent the entrance of birds and other objects into the draft box.

FIGS. 5 and 6 illustrate other embodiments of the present draft control plate 46 in which it is vertically mounted in a draft box 44. Although the orientation of the plate 46 has changed 90°, the positioning of the vertical adjustment device 72 and the horizontal adjustment device 80 and the principles of their operation remain substantially the same as those described above. With the plate pivoted at the top (FIG. 5), the horizontal adjustment device 80 is used to balance it in an open position while the vertical adjustment device 72 is used to vary its sensitivity. The same is true with the plate bottom pivoted (FIG. 6) except that the weight 88 and rod 84 of the horizontal device 80 have to counteract the tendency of the plate 46 to fall open. Moreover, the sensitivity of a vertically mounted draft control (which is very great since the plate does not have to overcome the force of its own weight when opening) plate can be greatly and advantageously reduced by mounting the horizontal and vertical adjustment devices on end of the plate opposite its pivot point, as shown at 96 in FIG. 6.

In conclusion, the draft control plate of the present invention provides for the automatic efficient operation of a furnace.

What is claimed is:

1. An automatic draft control plate for regulating the velocity of the draft in a furnace, comprising:

a plate;

means mounting said plate in an auxiliary channel in communication with the flue of said furnace for pivotal movement about an axis, said plate being substantially horizontally disposed when in a closed position;

a rod;

a counterweight mounted on said rod;

means connecting said rod to said plate and permitting adjustment of said rod both:

in a direction generally parallel to the plane of said plate to set an initial partially open plate position, and in a direction generally perpendicular to the plane of said plate to adjust the sensitivity of said plate to pivoting in response to changes in pressure differential across it.

2. The draft control plate of claim 1 wherein said plate is attached along one edge to a rotatable shaft and said means connecting said counterweight to said plate is attached to one end of said shaft.

3. The draft control plate of claim 1 wherein said means connecting said rod to said plate comprises a second rod disposed generally perpendicular to the first rod bearing said counterweight, said second rod being slidable with respect to said plate to adjust the sensitivity of said plate and said first rod being slidable with respect to said first rod to set said plate in an initially open position.

4. The draft control plate of claim 1, further comprising a baffle, mounted adjacent said plate.

5. The draft control plate of claim 1, further comprising auxiliary draft control means mounted in said auxiliary channel.

6. An automatic draft control plate used in regulating the draft of a furnace, comprising:

at least two plates mounted so as to be in communication with the flue of said furnace, each said plate comprising:

a counterweight; and means for attaching said counterweight to said plate such that said counterweight can be used to initially set said plate in a partially open position, said means further providing for adjustment of the affect of said counterweight on the rotation of said plate away from said initial position so as to vary the speed of said rotation in response to a given force, said plate compensating for changes in position of the other plate to maintain a uniform draft in said flue, said attaching means comprising a rod slidably attached to said plate and to said counterweight.

7. The draft control plate of claim 6 wherein said attaching means provides for the return of said plate to said initial position after said rotation.

8. The draft control plate of claim 6 wherein said rod is disposed and slidable in a plane substantially perpendicular to the plane of said plate.

9. The draft control plate of claim 6, further comprising a baffle mounted intermediate said plates.

10. The draft control plate of claim 6, further comprising an auxiliary damper.

11. A draft control assembly for regulating the draft in a furnace, comprising:

an auxiliary channel attached at one end to the flue of said furnace;

a draft box attached to the opposite end of said auxiliary channel;

at least one draft control plate mounted in said draft box, each said plate having means for initially setting said plate in a partially opened position and means for varying the sensitivity of the response of said plate to changes in pressure differential across it; and a manually operated, auxiliary damper mounted in said auxiliary channel for facilitating maintenance of said plate or plates, and for improving control of said draft control plate or plates in very gusty areas.

12. The draft control assembly of claim 11 in which at least one side of said draft box can be lifted for maintenance of said plate or plates.

13. The draft control assembly of claim 11 further comprising a screen attached to the bottom opening of said draft box to prevent the entrance of foreign objects therein.

14. The draft control assembly of claim 11 wherein two said draft control plates are mounted in said draft box, said draft control assembly further comprising a baffle mounted between said pair of plates to control the turbulence of incoming air.

15. An automatic draft control plate for regulating the velocity of the draft in a furnace, comprising:

a plate attached along one edge to a rotatable shaft and located in a channel adapted to be a communication with the flue of said furnace, said plate adapted to open or close in response to a change in pressure differential across it in order to maintain efficient draft conditions in said furnace;

a rod attached to one end of said shaft and disposed generally perpendicular to said plate, said rod being slidably adjustable along its axis; and a counter-weight attached to said rod so as to be slidably adjustable in a direction generally perpendicular to said rod, said counter-weight adaptable to adjustably apply a moment to said plate in order to set said plate in an initially open position, said rod being adjustable to vary the rate of change of said moment during said rotation of said plate in response to changes in pressure differential in order to adjust the sensitivity of said rotation, said counter-weight comprising a second rod having a weight slidably mounted therein.

16. An automatic draft control system for a furnace, comprising:

a pair of draft control plates mounted so as to be in communication with the flue of said furnace and the ambient air, each said draft control plate comprising:

a horizontal axis for rotatably mounting said plate, said plate rotating in response to changes in pressure differential across it;

means for setting said plate in an initially open position, said plate opening to permit the entrance of ambient air into said flue or closing to prevent the entrance of ambient air into said flue to maintain a uniform draft in said flue;

said plate automatically opening or closing in response to the closing or opening, respectively, of the other plate, to control the draft in said furnace at uniform levels regardless of changes in conditions acting on said draft control plates; and a baffle mounted between said draft control plates.

17. A control system for the draft in a flue of a furnace, comprising:

a channel in communication with said flue;

plural draft regulators mounted in said channel to provide means for automatically regulating the entrance of air into said flue, each said regulator being responsive to changes in pressure to provide means for compensating for fluctuations of the other of said regulators;

auxiliary draft control means mounted in said channel for maintaining a uniform draft in said flue; and baffle means mounted between said draft regulators for guiding the flow of air past said draft regulators.

18. The draft control system 17 further comprising means for initially setting said draft regulators in an open position to permit said regulators to either open or close in response to changes in pressure.

19. A draft control system for the draft in a flue of a furnace, comprising:

plural draft controllers for regulating the amount of aid entering in said flue to maintain a uniform draft in said flue, said controllers being independently operable to vary the amount of air entering said flue in response to changes in the amount of air permitted to enter said flue by other of said controllers; and baffle means mounted intermediate at least two of said controllers for checking the flow of air past said controllers.

20. The draft control plate of claim 4 wherein said counter-weight comprises a rod slidably attached to said rod of said attaching means.

* * * * *